US005376995A

United States Patent [19]

Yamamoto et al.

[11] Patent Number: 5,376,995

[45] Date of Patent: Dec. 27, 1994

[54] CONTACT CHARGER HAVING A CURVED SURFACE

[75] Inventors: Masashi Yamamoto, Settsu; Masaki Asano, Amagasaki; Keiko Nagayasu, Ibaraki; Akihito Ikegawa, Sakai, all of Japan

[73] Assignee: Minolta Camera Kabushiki Kaisha, Osaka, Japan

[21] Appl. No.: 142,709

[22] Filed: Oct. 25, 1993

[30] Foreign Application Priority Data

Oct. 30, 1992 [JP] Japan ..... 4-292602

[51] Int. Cl.[5] ..... G03G 15/02

[52] U.S. Cl. ..... 355/219; 361/225; 361/230

[58] Field of Search ..... 355/219; 361/225, 230, 361/235

[56] References Cited

U.S. PATENT DOCUMENTS 4,851,960 7/1989 Nakamura et al. ..... 361/225
5,060,014 10/1991 Adachi et al. ..... 365/219 X
5,068,762 11/1991 Yoshihara ..... 361/225
5,192,974 3/1993 Ikegawa et al. ..... 355/219
5,278,614 1/1994 Ikegawa et al. ..... 355/219

FOREIGN PATENT DOCUMENTS 4-51265 2/1992 Japan ..... 355/219

*Primary Examiner*—A. T. Grimley
*Assistant Examiner*—William J. Royer
*Attorney, Agent, or Firm*—Willian Brinks Hofer Gilson & Lione

[57] ABSTRACT

A contact charger in an electrophotographic image forming apparatus for electrostatically charging a photosensitive, latent image support surface of a rotatably supported photosensitive drum in contact therewith. The contact charger comprises a generally elongated carrier and a charging member carried at a first side edge by the carrier. This charging member has a second side edge opposite to the first side edge which is held in sliding contact with the photosensitive surface over a predetermined contact distance. The charging member has a curved surface of a radius of curvature of 0.02 to 1.0 mm at a side edge portion thereof at which contact of the charging member with the photosensitive surface terminates. A power source for applying a voltage to the charging member is also employed.

18 Claims, 3 Drawing Sheets

CONTACT CHARGER HAVING A CURVED SURFACE

BACKGROUND OF THE INVENTION

1. Field of the Invention

The present invention relates generally to a charger for use in an image forming apparatus such as, for example, a copier or a printer and, more particularly, to a contact charger for electrostatically charging a photosensitive member by bringing a charging member into contact with such photosensitive member.

2. Description of the Related Art

In an electrophotographic image forming apparatus such as a copier, a printer or the like, image formation is performed by charging a photosensitive member with the use of a charger; forming an electrostatic latent image on a charged region of the photosensitive member by subsequent exposure to imagewise rays of light; developing the electrostatic latent image into a visible powder image; transferring the visible powder image onto a transfer material; and fixing the transferred visible powder image.

Various types of chargers are known and are broadly classified into corona chargers, wherein corona discharge is utilized, and contact chargers wherein the surface of the photosensitive member is brought into contact with a charging member such as, for example, a charging brush, a charging roller, a charging blade or a rotatably arranged endless charging belt.

The corona chargers have the advantage of providing a stable charging process, but have the disadvantage of producing a large amount of ozone, which tends to cause deterioration of the photosensitive member and to adversely affect human bodies. Because of this, the contact chargers are noticed which produce considerably less ozone than the corona chargers.

The contact chargers, however, have some disadvantages. The chargers employing the charging brush have the disadvantage of requiring much time to make the brush. The chargers employing the charging roller have a complicated structure because they require means for driving the roller. In addition, because the roller is left in contact with a photosensitive drum even when the image forming apparatus is at a standstill, creep deformation strains remain on the contact portion, thus resulting in insufficient charging. The chargers employing the endless belt have the disadvantage of increasing the size of the image forming apparatus and requiring a complicated structure for driving the belt.

SUMMARY OF THE INVENTION

The present invention has been developed to overcome the above-described disadvantages and has for its object to provide an improved highly reliable contact charger capable of stably charging a photosensitive member held in contact therewith.

Another object of the present invention is to provide the contact charger of the above-described type which has a simple structure and can be readily manufactured at a low cost.

In accomplishing the above and other objects, the contact charger according to the present invention is held in contact with an external peripheral surface of an electrostatic latent image support member to thereby charge the electrostatic latent image support member. The contact charger comprises a carrier, a charging member carried by the carrier and held in contact with the external peripheral surface of the electrostatic latent image support member over a predetermined length adjacent to a free side portion of the charging member, and a power source for applying a voltage to the charging member. The charging member has a curved surface of a radius of curvature of 0.02 to 1.0 mm at a contact edge portion thereof at which contact of the charging member with the electrostatic latent image support member terminates.

Conveniently, the free side portion of the charging member is bent or folded backwards at the contact edge portion, to thereby provide the curved surface.

Preferably, the charging member has a volume resistivity of not greater than $10^9$ Ω.cm, and the predetermined length over which the charging member is held in contact with the external peripheral surface of the electrostatic latent image support member ranges from 1 to 10 mm.

Advantageously, the voltage applied to the charging member includes a DC voltage component of 800 to 1500 V.

In another aspect of the present invention, the contact charger comprises a carrier, a flexible charging member having a fixed side edge carried by the carrier and a free side edge positioned downstream from the fixed side edge with respect to the direction of rotation of the electrostatic latent image support member, and a power source for applying a voltage to the charging member. The charging member is held uniformly in contact with the external peripheral surface of the electrostatic latent image support member over a predetermined length adjacent to the free side edge by the action of electrostatic adsorption, and has a curved surface of a radius of curvature of 0.02 to 1.0 mm at a contact edge portion thereof at which contact of the charging member with the electrostatic latent image support member terminates.

By the above-described construction, when the electrostatic latent image support member is rotated with the voltage from the power source applied to the charging member, the charging member closely adheres to the support member by an electrostatic adsorptivity generated by a voltage difference between the charging member and the support member. At the same time, an electric discharge takes place at a region where the peripheral surface of the support member gradually approaches the charging member upon rotation thereof, with the external peripheral surface of the support member being charged. Furthermore, the charged portion of the support member is stabilized at a contact region where the support member and the charging member are held in contact with each other.

In addition, because the contact edge portion of the charging member has the curved surface, the extent to which an electric field is concentrated in the proximity of the contact edge portion is relatively low and, hence, the charged condition of the support member is reliably maintained.

BRIEF DESCRIPTION OF THE DRAWINGS

The above and other objects and features of the present invention will become more apparent from the following description of preferred embodiments thereof with reference to the accompanying drawings, throughout which like parts are designated by like reference numerals, and wherein.

DETAILED DESCRIPTION OF THE PREFERRED EMBODIMENTS

Figure 1:
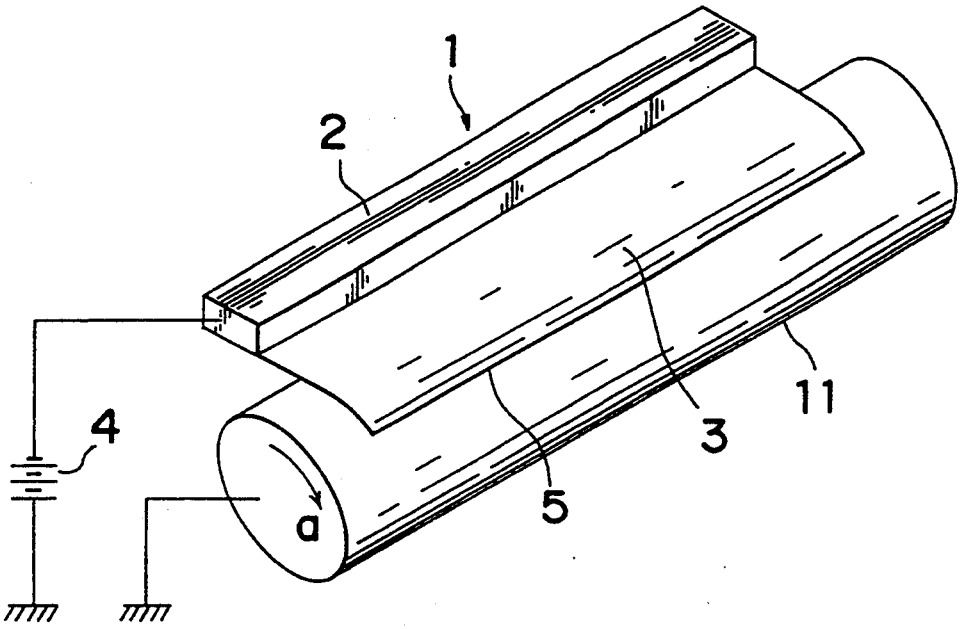
FIG. 1 is a schematic perspective view of a contact charger according to the present invention.
Figure 2:
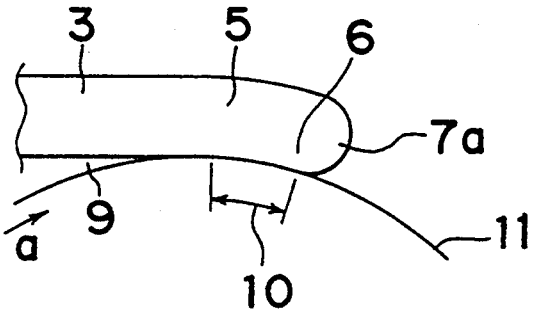
FIG. 2 is a side view of a free end of a charging member mounted in the charger of FIG. 1.

Referring now to the drawings, there is schematically shown in FIG. 1 a contact charger 1 embodying the present invention.

The charger 1 shown in FIG. 1 comprises a generally elongated carrier 2 extending parallel to a photosensitive drum 11 having a photosensitive surface on its outer periphery, a generally rectangular charging member 3 extending parallel to the photosensitive drum 11 and secured at one side edge portion to the carrier 2, and a charging power source 4 electrically connected with the carrier 2. The charging member 3 is a flexible strip sheet made of electroconductive material or material having a low resistance. A free side edge 5 of the charging member 3 remote from the carrier 2 has a contact edge portion 6 held lightly in contact with the photosensitive surface of the photosensitive drum 11 at a contact pressure close to substantially zero.

As shown in FIGS. 2 to 6, the contact edge portion 6 of the charging member 3 is formed with a curved surface (shown by *7a* in FIG. 2, *7b* in FIG. 3, *7c* in FIG. 4, *7d* in FIG. 5 or *7e* in FIG. 6) of a radius of curvature within the range of 0.02 to 1.0 mm, at which the contact between the charging member 3 and the photosensitive drum 11 terminates.

The curved surface *7a* at the contact edge portion 6 of the charging member 3 may be formed by grinding the free side edge of the charging member 3 or in any suitable manner.

Figure 3:
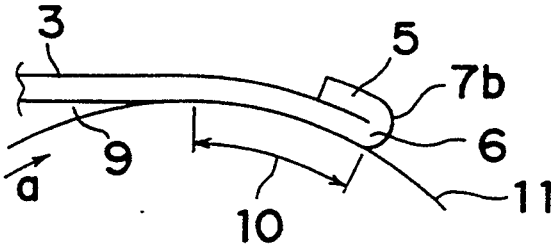
FIG. 3 is a view similar to FIG. 2, but indicating a modification thereof.

Alternatively, the curved surface may be formed, as shown by *7b* in FIG. 3, by folding the free side edge of the charging member 3 backwardly to overlap in contact with the remaining portion of the charging member 3. Again alternatively, the curved surface as shown by *7c* in FIG. 4 may be formed by folding the free side edge of the charging member 3 backwardly to overlay the remaining portion of the charging member 3 with a strip-shaped spacer 83 intervening therebetween, or the curved surface as shown by *7d* in FIG. 5 may be formed by curling the free side edge of the charging member so as to encircle a rod-like spacer 84. Also, as shown by *7e* in FIG. 6, the curved surface may be formed by bending the free side edge of the charging member so as to extend radially outwardly away from the photosensitive drum 11.

The contact charger 1 of the above-described construction operates as follows.

When the photosensitive drum 11 is rotated in a direction shown by an arrow (a) with a voltage applied from the power source 4 to the charging member 3, the charging member 3 is attracted to slidingly contact the photosensitive surface of the photosensitive drum 11 by the action of an electrostatic adsorptivity generated by a voltage difference between the charging member 3 and the photosensitive drum 11. At this moment, an electric discharge takes place from the charging member 3 towards the photosensitive surface of the photosensitive drum 11 at a region 9 delimited between the charging member 3 and an upstream portion of the photosensitive surface of the photosensitive drum 11 on a trailing side with respect to the direction of rotation of the photosensitive drum 11, to thereby electrostatically charge the photosensitive surface of the photosensitive drum 11. After the surface of the photosensitive drum 11 has been charged to a predetermined voltage at this region 9, the charged area of the photosensitive surface of the photosensitive drum 11 is stabilized as it is, during a continued rotation of the photosensitive drum 11, brought to a contact region 10 where the photosensitive drum 11 is held in contact with the charging member 3.

It is preferred that the length of the contact region 10, that is, the angular length of the photosensitive surface of the photosensitive drum over which the free side edge 5 of the charging member is held in contact therewith, is chosen to be within the range of 1 to 10 mm. The charging member 3 can be held more stably in contact with the photosensitive surface of the photosensitive drum 11 if a voltage including a DC voltage component of 800–1500 V is applied to the photosensitive drum 11.

Because the free side edge 5 of the charging member 3 has the curved surface (shown by *7a* in FIG. 2, *7b* in FIG. 3, *7c* in FIG. 4, *7d* in FIG. 5 or *7e* in FIG. 6), concentration of an electric field generated by the voltage applied to the charging member 3 which would take place considerably if an edge exists in the charging member is advantageously minimized in the presence of the curved surface confronting the photosensitive surface.

During the continued rotation of the photosensitive drum 11, the photosensitive surface thereof passes underneath the charging member 3 and progressively departs from the contact region 10 between the charging member 3 and the photosensitive surface of the photosensitive drum 11. Accordingly, even though one or both of the photosensitive drum 11 and the carrier 2 undergo vibration under the influence of vibrations generated by a driving system, the contact edge portion 6 is held stably in contact with the photosensitive surface of the photosensitive drum 11, thereby providing a generally uniform charging characteristic thereon.

Figure 4:
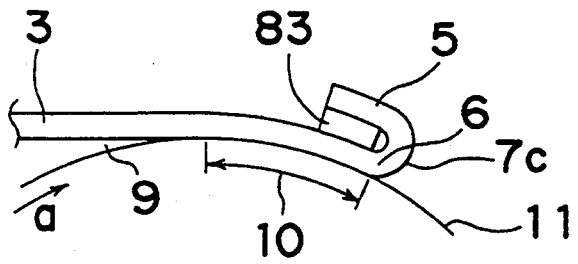
FIG. 4 is a view similar to FIG. 2, but indicating another modification thereof.
Figure 5:
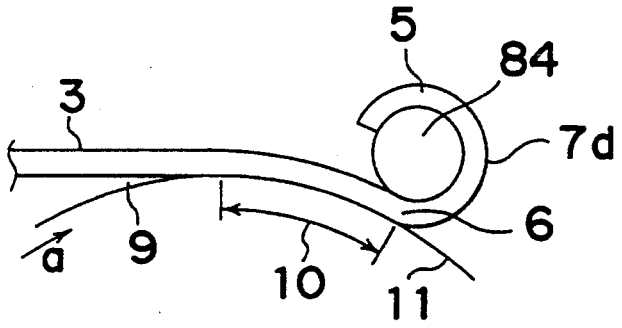
FIG. 5 is a view similar to FIG. 2, but indicating a further modification thereof.
Figure 6:
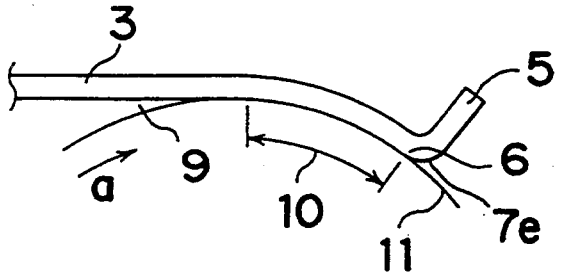
FIG. 6 is a view similar to FIG. 2, but indicating a still further modification thereof.

Furthermore, where the curved surface at the contact edge portion 6 of the charging member 3 is formed by folding as described hereinbefore and as shown in FIGS. 3 to 5, the strength of the free side edge 5, particularly the contact edge portion 6, of the charging member 3 is advantageously increased enough to avoid the generation of wrinkles, which has hitherto been caused by stresses generated by the rotation or stop of the photosensitive drum 11. Accordingly, the photosensitive surface of the photosensitive drum 11 having passed the contact region 10 is charged to a predetermined voltage.

The charging member 3 is in the form of a flexible member having an electroconductivity and a low electric resistance, and the material, thickness or the like thereof is not limited if the charging member 3 closely adheres to the photosensitive surface of the photosensitive drum 11 over a sufficient angular distance by the action of electrostatic adsorption. In general, the electroconductivity or the low-resistivity is imparted by dispersing electroconductive material in a sheet of metallic material or synthetic resin, or by subjecting the surface of a synthetic resin sheet to a suitable treatment by which it can be rendered electroconductive. In view of the charging characteristic, it is preferred that the charging member 3 has a volume resistivity of not greater than $10^9$ Ω.cm and, preferably, within the range of $10^3$–$10^8$ Ω.cm.

Various experiments were carried out in order to examine a change in electrostatic charge build up on the photosensitive surface of the photosensitive drum 11 and a change in image quality resulting from printing.

A polyethylene film in which a conductive carbon powder was dispersed and which had a thickness of 50 μm, a Young's modulus of $7.4\times10^6$ g/cm$^2$, a bending moment (M) of 0.15 g.cm, and a volume resistivity of $10^3$ Ω.cm was employed as the charging member 3. The free side edge of the charging member 3 was folded backwardly as shown in FIG. 3 so as to overlap the remaining portion of the charging member 3 over an overlapping distance of 2 mm, that is, with the backwardly folded portion having a length of 2 mm.

Figure 8:
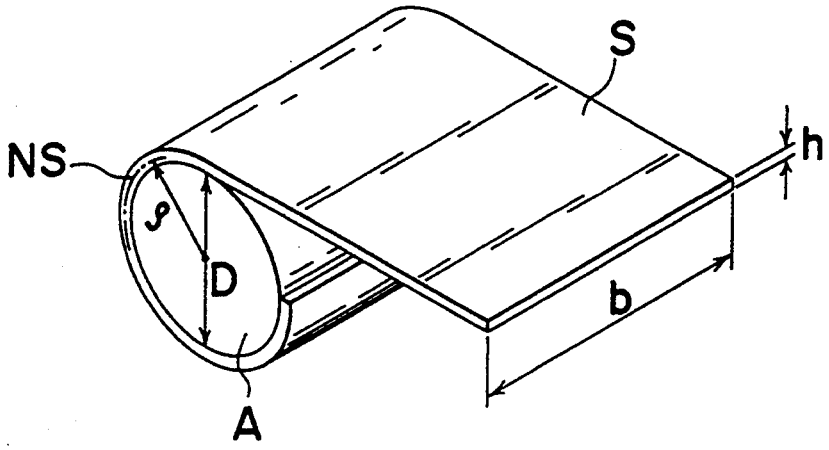
FIG. 8 is a perspective view of the charging member, showing the bending moment applied thereto.

It is to be noted here that the bending moment M is a moment required for turning the charging member of 1 cm in width b around a rod A having a round section of 1 cm in diameter D as shown in FIG. 8. This moment M is given by $M=EI/\rho(I=bh^3/12)$, where E represents the Young's modulus (g/cm$^2$) of elasticity of the charging member; I represents the moment of inertia of the cross section (cm$^4$) of the charging member; ρ represents the radius of curvature (cm), that is, the distance between the center of curvature of the rod A and the neutral plane NS of the charging member; and h represents the thickness of the charging member.

The photosensitive drum 11 employed was of a type having an outer diameter of 30 mm and having an organic photosensitive surface, and was driven at a peripheral velocity of 35 mm/sec. Furthermore, the voltage applied to the charging member 3 from the power source 4 was chosen to be −1200 V.

In the experiments to evaluate the charging characteristic of the photosensitive drum 11, a surface potentiometer identified by model 360 and manufactured by TREK, Inc. was used to measure the initial voltage of the charged photosensitive drum 11 and the surface voltage of the photosensitive drum 11 after a 1×4 dot matrix pattern of black points in which the black points are spaced one dot from the neighboring black points was printed on the entire surface of 500 sheets of A4-size papers at an image density of 300 dpi. During the experiments, a change in surface voltage in a direction widthwise of the photosensitive drum 11 was also measured. The location at which the measurements were carried out was angularly displaced about 75° downstream from the contact region 10 between the charging member 3 and the photosensitive surface of the photosensitive drum 11 with respect to the direction of rotation of the photosensitive drum 11.

In the experiments to evaluate the image quality, with the use of a densitometer identified by model PDA-65 and manufactured by Konica Kabushiki Kaisha of Japan, the image density and a change in image density in the width direction of the photosensitive drum 11 were measured at the initial stage of the printing and after the 1×4 dot matrix pattern was printed on 500 sheets of A4-size papers.

Figure 7:
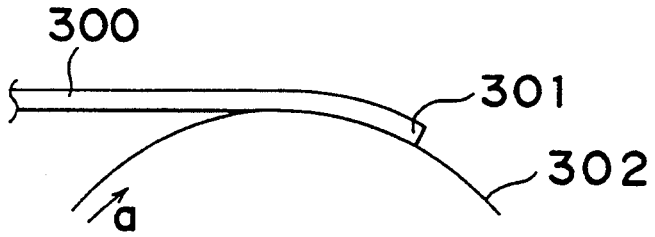
FIG. 7 is a view similar to FIG. 2, but indicating a charging member according to a comparative example.

For the purpose of comparison with the contact charger according to the present invention, the similar experiments were carried out to evaluate the charging characteristic and the image quality, using a contact charger of a structure wherein, as shown in FIG. 7, a charging member 300 had a sharp free side edge 301 held in contact with a photosensitive member 302 (this charger is hereinafter referred to as a comparison charger). As is the case with the contact charger according to the present invention, a polyethylene film was employed as the charging member 300.

Table 1 indicates results of the experiments carried out with the charger according to the present invention to evaluate the charging characteristic of the photosensitive member.

TABLE 1

| | |
|---|---|
| Initial surface voltage ($V_1$) | −800 V |
| Change in initial surface voltage ($\Delta V_1$) | ±100 V |
| Surface voltage after 500 sheets were printed ($V_{500}$) | −800 V |
| Change in surface voltage after 500 sheets were printed ($\Delta V_{500}$) | ±110 V |

Table 2 indicates results of the similar experiments carried out with the comparison charger.

TABLE 2

| | |
|---|---|
| Initial surface voltage ($V_1'$) | −820 V |
| Change in initial surface voltage ($\Delta V_1'$) | ±250 V |
| Surface voltage after 500 sheets were printed ($V_{500}'$) | −800 V |
| Change in surface voltage after 500 sheets were printed ($\Delta V_{500}'$) | ±330 V |

Table 3 indicates results of the experiments carried out with the charger according to the present invention to evaluate the image quality.

TABLE 3

| | |
|---|---|
| Initial image density ($ID_1$) | 0.42 |
| Change in initial image density ($\Delta ID_1$) | ±0.04 |
| Image density after 500 sheets were printed ($ID_{500}$) | 0.42 |
| Change in image density after 500 sheets were printed ($\Delta ID_{500}$) | ±0.04 |

Table 4 indicates results of the similar experiments carried out with the comparison charger.

TABLE 4

| | |
|---|---|
| Initial image density ($ID_1'$) | 0.40 |
| Change in initial image density ($\Delta ID_1'$) | ±0.12 |
| Image density after 500 sheets were printed ($ID_{500}'$) | 0.39 |
| Change in image density after 500 sheets were printed ($\Delta ID_{500}'$) | ±0.16 |

As discussed hereinabove, in the charger according to the present invention, the initial surface voltage ($V_1=-800$ V) was identical with the surface voltage ($V_{500}=-800$ V) after 500 sheets of A4-size papers were printed, and each of the change in initial surface voltage ($\Delta V_1=\pm100$ V) and the change in surface voltage ($\Delta V_{500}=\pm110$ V) was small and the difference therebetween was very small (10 V).

Furthermore, the initial image density ($ID_1=0.42$) and the image density ($ID_{500}=0.42$) after 500 sheets of A4-size papers were printed were both low, and the change in initial image density ($\Delta ID_1=0.04$) and the change in image density ($\Delta ID_{500}=0.04$) after 500 sheets of A4l -size papers were printed were both small.

On the other hand, in the comparison charger, there arose a voltage difference of 20 V between the initial surface voltage ($V_1'=-820$ V) and the surface voltage ($V_{500}'=-800$ V) after 500 sheets of A4-size papers were printed. The change in initial surface voltage ($\Delta V_1'=\pm 250$ V) and the change in surface voltage ($\Delta V_{500}'=\pm 330$ V) after 500 sheets of A4-size papers were printed were both considerable as compared with those ($\Delta V_1=\pm 100$ V, $\Delta V_{500}=\pm 110$ V) of the charger according to the present invention, respectively. In addition, the difference therebetween ($|\Delta V_1'|-|\Delta V_{500}'|=-80$ V) was considerably greater than that ($|\Delta V_1|-|\Delta V_{500}|=-10$ V) in the charger according to the present invention.

In the comparison charger, although no considerable change could not be found between the initial image density ($ID_1'=0.40$) and the image density ($ID_{500}'=0.39$) after the printing of 500 sheets of A4-size papers, the change in initial image density ($\Delta ID_1'=0.12$) and the change in image density ($\Delta ID_{500}'=0.16$) after the printing of 500 sheets of A4-size papers were both considerable as compared with those ($\Delta ID_1$, $\Delta ID_{500}=0.04$) of the charger according to the present invention, respectively.

It can be understood from the above that the charger according to the present invention in which the charging member 3 has the curved surface provides a remarkably stabilized charging characteristic over the overall length of the photosensitive drum 11, thereby maintaining the image density stable for a long time.

It is conceivable that unstable charging characteristic in the comparison charger is primarily due to the presence of sharp edges at the free side edge 301 of the charging member 300 at which contact thereof with the photosensitive member 302 terminates, and an electric field concentrated at the sharp edges brings about a discharge phenomenon which would become unstable by vibrations induced by the drive of the photosensitive member 302 or a microscopic change in the contact condition, or by the action of wrinkles produced by stresses generated by the rotation or stop of the photosensitive member 302.

Two kinds of experiments were carried out to evaluate the curvature of the curved surface of the charging member.

A charging member used in the first experiments was a polyethylene terephthalate film in which conductive carbon powder was dispersed and which had a thickness of 75 μm, a Young's modulus of elasticity of $10.2\times 10^6$ g/cm$^2$, a bending moment (M) of 0.71 g.cm, and a volume resistivity of $10^6$ Ω.cm. The curvature of the curved surface of the charging member was changed by folding the free side edge of the charging member backwardly as shown in FIG. 4, and by changing the thickness of a strip-shaped spacer sandwiched between opposed portions of the charging member at the backwardly folded area within the range of 0 to 2.0 mm. The backwardly folded portion having the spacer of a thickness of 0 mm means the absence of the spacer as shown in FIG. 3, and the same is true for the second experiments.

A charging member used in the second experiments was made of polyethylene terephthalate and had one surface with a conductive coating. This charging member had a thickness of 25 μm, a Young's modulus of elasticity of $1.0\times 10^6$ g/cm$^2$, a bending moment (M) of $2.6\times 10^{-3}$ g.cm, and a conductive coating surface resistance of $9\times 10^6$ Ω/cm. The curvature of the curved surface of the charging member was changed by utilizing a rod-like spacer in the curved free side edge of the charging member as shown in FIG. 5 and by changing the diameter of the rod-like spacer.

With the use of these charging members, the change in initial surface voltage ($\Delta V_1$), the change in initial image density ($\Delta ID_1$), the change in surface voltage ($\Delta V_{500}$) after 500 sheets of A4-size papers were printed, and the change in image density ($AID_{500}$) after 500 sheets of A4-size papers were printed were measured, and each of them was evaluated by visually observing unevenness in density of the 1×4 dot matrix pattern. Moreover, the same experiments were carried out using the charging member shown in FIG. 7 and having sharp edges at the free side edge 301 thereof.

Table 5 indicates results of the first experiments wherein t represents the thickness (mm) of the spacer, $\phi$ the thickness (mm) of the spacer, $r_c$ the radius of curvature (mm), $N_{U1}$ results of evaluation with respect to the unevenness in initial image density, $N_{U500}$ results of evaluation with respect to the unevenness in image density after 500 sheets of A4-size papers were printed, and Sp the spacer.

Symbols used in evaluating the image density are as follows.

O: Unevenness in density was slight and the density was relatively uniform.

Δ: Unevenness in density could be confirmed, but could be practically safely ignored.

x: Unevenness of density was deemed to be serious.

Table 6 indicates results of the second experiments.

TABLE 5

| | t | $r_c$ | $\Delta V_1$ | $\Delta ID_1$ | $N_{U1}$ | $\Delta V_{500}$ | $\Delta ID_{500}$ | $N_{U500}$ | Struc. | Remarks |
|---|---|---|---|---|---|---|---|---|---|---|
| Experiment 1 | 0 | 0.075 | 80 | 0.02 | ○ | 150 | 0.05 | ○ | FIG. 3 | No Sp |
| Experiment 2 | 0.05 | 0.100 | 120 | 0.03 | ○ | 140 | 0.04 | ○ | FIG. 4 | |
| Experiment 3 | 0.20 | 0.175 | 110 | 0.03 | ○ | 100 | 0.02 | ○ | FIG. 4 | |
| Experiment 4 | 0.50 | 0.325 | 130 | 0.03 | ○ | 120 | 0.03 | ○ | FIG. 4 | |
| Experiment 5 | 0.80 | 0.475 | 120 | 0.03 | ○ | 120 | 0.03 | ○ | FIG. 4 | |
| Experiment 6 | 1.00 | 0.575 | 130 | 0.04 | ○ | 140 | 0.04 | ○ | FIG. 4 | |
| Experiment 7 | 1.50 | 0.825 | 220 | 0.10 | Δ | 200 | 0.09 | Δ | FIG. 4 | |
| Experiment 8 | 2.00 | 1.075 | 280 | 0.14 | x | 270 | 0.14 | x | FIG. 4 | |
| Experiment 9 | — | — | 250 | 0.15 | x | 300 | 0.18 | x | FIG. 7 | |

TABLE 6

| | $\phi$ | $r_c$ | $\Delta V_1$ | $\Delta ID_1$ | $N_{U1}$ | $\Delta V_{500}$ | $\Delta ID_{500}$ | $N_{U500}$ | Struc. | Remarks |
|---|---|---|---|---|---|---|---|---|---|---|
| Experiment 10 | 0 | 0.025 | 80 | 0.02 | ○ | 110 | 0.03 | ○ | FIG. 3 | No Sp |
| Experiment 11 | 0.10 | 0.075 | 80 | 0.02 | ○ | 110 | 0.03 | ○ | FIG. 5 | |
| Experiment 12 | 0.50 | 0.125 | 100 | 0.02 | ○ | 100 | 0.02 | ○ | FIG. 5 | |

TABLE 6-continued

| | $\phi$ | $r_c$ | $\Delta V_1$ | $\Delta ID_1$ | $N_{U1}$ | $\Delta V_{500}$ | $\Delta ID_{500}$ | $N_{U500}$ | Struc. | Remarks |
|---|---|---|---|---|---|---|---|---|---|---|
| Experiment 13 | 1.00 | 0.575 | 120 | 0.03 | ∘ | 120 | 0.03 | ∘ | FIG. 5 | |
| Experiment 14 | 1.50 | 0.775 | 160 | 0.07 | ∘ | 120 | 0.03 | ∘ | FIG. 5 | |
| Experiment 15 | 2.00 | 1.025 | 200 | 0.10 | Δ | 190 | 0.09 | Δ | FIG. 5 | |
| Experiment 16 | 3.00 | 1.525 | 340 | 0.18 | x | 300 | 0.17 | x | FIG. 5 | |
| Experiment 17 | — | — | 230 | 0.15 | x | 280 | 0.18 | x | FIG. 7 | |

As is clear from the results of the above experiments, the curvature $r_c$ of the curved surface of the charging mender must be not greater than 1 mm. Furthermore, the provision of the curved surface having a curvature less than 0.02 mm not only results in an increase in manufacturing cost of the charging men, but, but also brings about the problem such that an electric field would be concentrated at the contact edge portion of the charging member. Accordingly, the curvature of the curved surface should be so chosen as to range from 0.02 to 1.0 mm.

From the foregoing, according to the present invention, because the contact edge portion of the charging member with respect to the photosensitive member has the curved surface, the extent to which the electric field is concentrated in the proximity of the contact edge portion is relatively low, and the condition in which the contact edge portion of the charging member is in contact with the photosensitive member is stabilized. Accordingly, not only uniform charge is imparted to the surface of the photosensitive member having passed the contact region with the charging member, but also a substantially constant voltage is maintained for a long time.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A contact charger for electrostatically charging a photosensitive, latent image support member in contact therewith, said contact charger comprising:

a carrier;

a charging member carried by said carrier and having a free portion remote from said carrier, said free portion being held in contact with the photosensitive member over a predetermined contact distance, said charging member having a curved surface of a radius of curvature of 0.02 to 1.0 mm at a contact edge portion thereof at which contact of said charging member with the photosensitive member terminates; and a power source for applying a voltage to said charging member.

2. The contact charger according to claim 1, wherein the free portion of said charging member is folded backwardly at the contact edge portion thereof.

3. The contact charger according to claim 2, wherein the free portion of said charging member is bent to extend radially outwardly away from the photosensitive member.

4. The contact charger according to claim 2, further comprising a spacer securely held in a folded portion of said charging member.

5. The contact charger according to claim 1, wherein said charging member has a volume resistivity of not greater than $10^9$ Ω.cm.

6. The contact charger according to claim 1, wherein said predetermined contact distance ranges from 1 to 10 mm.

7. The contact charger according to claim 6, wherein the voltage applied to said charging member includes a DC voltage component of 800 to 1500 V.

8. A contact charger for electrostatically charging a photosensitive, latent image support member in contact therewith, said contact charger comprising:

a carrier;

a flexible charging member having a fixed portion, secured to said carrier, and a free portion opposite to said fixed portion and positioned on a leading side with respect to a direction of rotation of the photosensitive member, said free portion of said charging member being held uniformly in contact with the photosensitive member over a predetermined contact distance by the action of electrostatic adsorption, said charging member having a curved surface of a radius of curvature of 0.02 to 1.0 mm at a contact edge portion thereof at which contact of said charging member with the photosensitive member terminates; and a power source for applying a voltage to said charging member.

9. The contact charger according to claim 8, wherein said charging member has a volume resistivity of not greater than $10^9$ Ω.cm.

10. The contact charger according to claim 8, wherein said predetermined contact distance ranges from 1 to 10 mm.

11. The contact charger according to claim 10, wherein the voltage applied to said charging member includes a DC voltage component of 800 to 1500 V.

12. A contact charger in an electrophotographic image forming apparatus for electrostatically charging a photosensitive, latent image support surface of a rotatably supported photosensitive drum in contact therewith, said contact charger comprising:

a generally elongated carrier;

a charging member carried at a first side edge by said carrier, said charging member having a second side edge opposite to said first side edge and held in sliding contact with the photosensitive surface over a predetermined contact distance, said charging member having a curved surface of a radius of curvature of 0.02 to 1.0 mm at a side edge portion thereof at which contact of said charging member with the photosensitive surface terminates; and a power source for applying a voltage to said charging member.

13. The contact charger according to claim 12, wherein the second side edge of said charging member is folded backwardly to define the side edge portion.

14. The contact charger according to claim 13, wherein the second side edge of said charging member is bent to extend radially outwardly away from the photosensitive surface to thereby define the side edge portion.

15. The contact charger according to claim 13, further comprising a spacer securely held in a folded portion of said charging member.

16. The contact charger according to claim 12, wherein said charging member has a volume resistivity of not greater than $10^9$ Ω.cm.

17. The contact charger according to claim 12, wherein said predetermined contact distance ranges from 1 to 10 mm.

18. The contact charger according to claim 17, wherein the voltage applied to said charging member includes a DC voltage component of 800 to 1500 V.

* * * * *